US007171928B2

(12) United States Patent
Tomita

(10) Patent No.: US 7,171,928 B2
(45) Date of Patent: Feb. 6, 2007

(54) CYLINDER BLOCK FOR INTERNAL COMBUSTION ENGINE

(75) Inventor: Tetsuo Tomita, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/957,703

(22) Filed: Oct. 5, 2004

(65) Prior Publication Data

US 2005/0076860 A1 Apr. 14, 2005

(30) Foreign Application Priority Data

Oct. 10, 2003 (JP) ..... 2003-351580

(51) Int. Cl.
*F02F 1/00* (2006.01)

(52) U.S. Cl. ..... 123/41.74; 123/195 R

(58) Field of Classification Search ..... 123/41.74, 123/41.31, 41.15, 195 R
See application file for complete search history.

(56) References Cited

U.S. PATENT DOCUMENTS 4,517,945 A 5/1985 Ishigami et al.
4,993,378 A 2/1991 Sakurahara et al.
5,131,357 A * 7/1992 Inoue et al. ..... 123/41.74
5,915,346 A 6/1999 Rehr
6,276,338 B1 * 8/2001 Kato et al. ..... 123/470
6,295,956 B1 * 10/2001 Kato et al. ..... 123/41.82 R

FOREIGN PATENT DOCUMENTS

JP 61-117418 A 6/1986
JP 6-193502 A 7/1994
JP 6193502 A * 7/1994
JP 2001-115836 A 4/2001
JP 2002-364360 A 12/2002
JP 2003-322054 A 11/2003

* cited by examiner

*Primary Examiner*—Stephen K. Cronin
*Assistant Examiner*—Jason Benton
(74) *Attorney, Agent, or Firm*—Foley & Lardner LLP

(57) ABSTRACT

A cylinder block for an internal combustion engine is formed with a knock sensor mounting boss formed on a block side wall, and designed to support an engine knock sensor. The cylinder block further includes a tubular rib projecting from the block side wall, extending in a cylinder row direction over a plurality of cylinders, and being connected with the knock sensor mounting boss.

11 Claims, 4 Drawing Sheets

CYLINDER BLOCK FOR INTERNAL COMBUSTION ENGINE

BACKGROUND OF THE INVENTION

The present invention relates to a cylinder block for a multi-cylinder internal combustion engine, and more specifically to technique for sensing knocking accurately.

Knocking is undesired vibrations of gases in a combustion engine resulting from spontaneous ignition of unburnt gas mixture in a terminal portion of the combustion chamber. Violent knocking causes unpleasant vibrations and noise, and incurs a decrease in the output power and deterioration in fuel consumption due to energy loss. To avoid the problem of knocking, an engine of some type is provided with a control system for performing a control operation such as retardation of ignition timing in accordance with a signal from a knock sensor mounted in a knock sensor mounting boss of a cylinder block.

A Published Japanese Patent Application Publication No. H06(1994)-193502 shows a knock sensor mounting boss for a multi-cylinder engine. One side wall of a cylinder block is formed with a rib connecting projection parts of vertically extending oil drain holes, so as to transmit knocking vibrations to the knock sensor mounting boss.

SUMMARY OF THE INVENTION

However, it is not easy to sense knocking vibrations by a single knock sensor disposed at the middle of a cylinder row specifically when knocking takes place in a cylinder remote from the knock sensor.

It is an object of the present invention to provide a cylinder block designed to transmit knocking vibrations effectively to a knock sensor mounting position.

According to the present invention, a cylinder block for an internal combustion engine, comprises: a knock sensor mounting boss formed on a block side wall, and designed to support an engine knock sensor; and a tubular rib which projects from the block side wall, which extends in a cylinder row direction over a plurality of cylinders, and which is connected with the knock sensor mounting boss.

DETAILED DESCRIPTION OF THE INVENTION

Figure 1:
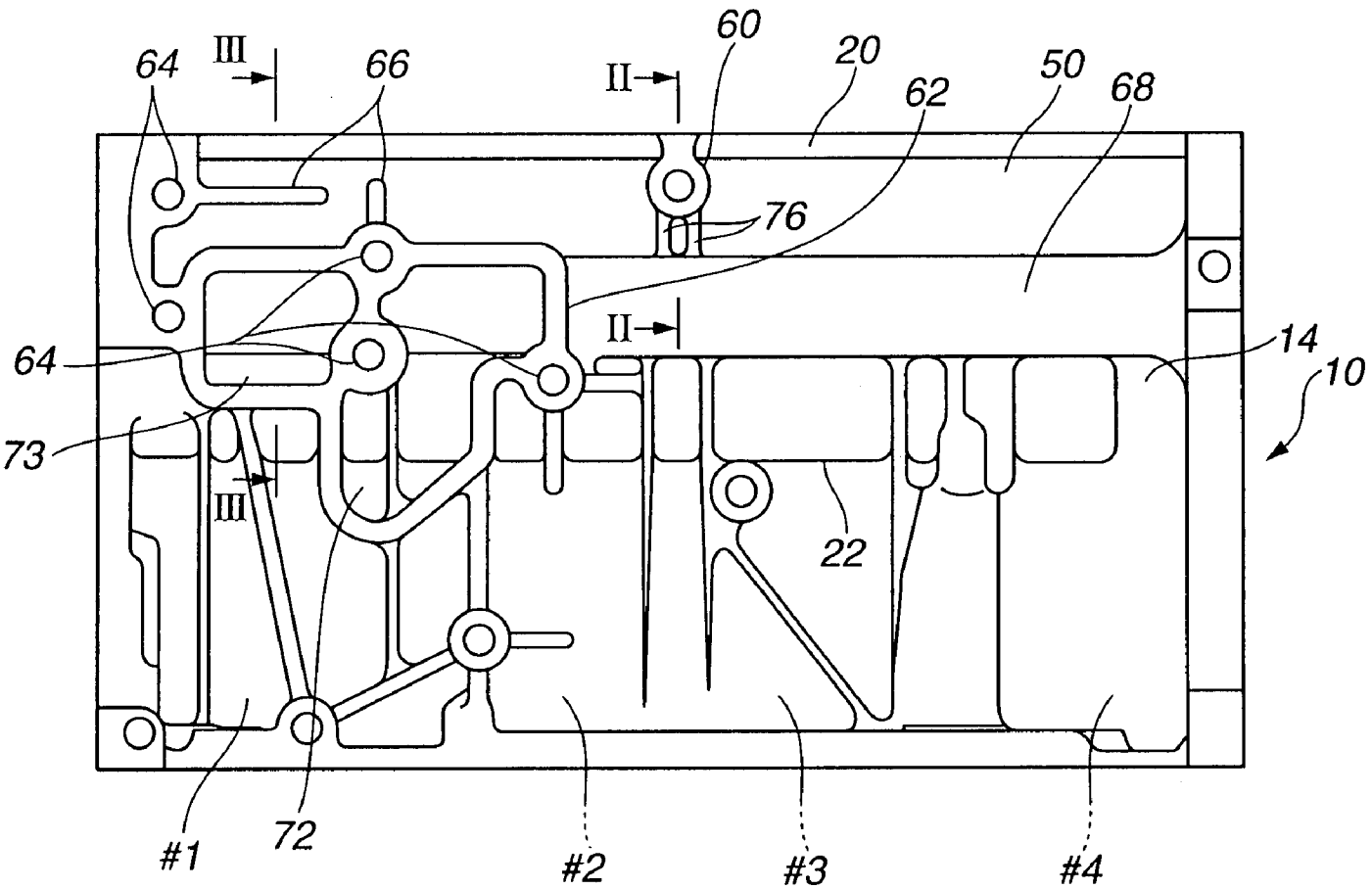
FIG. 1 is a side view of a cylinder block according to a first embodiment of the present invention.
Figure 2:
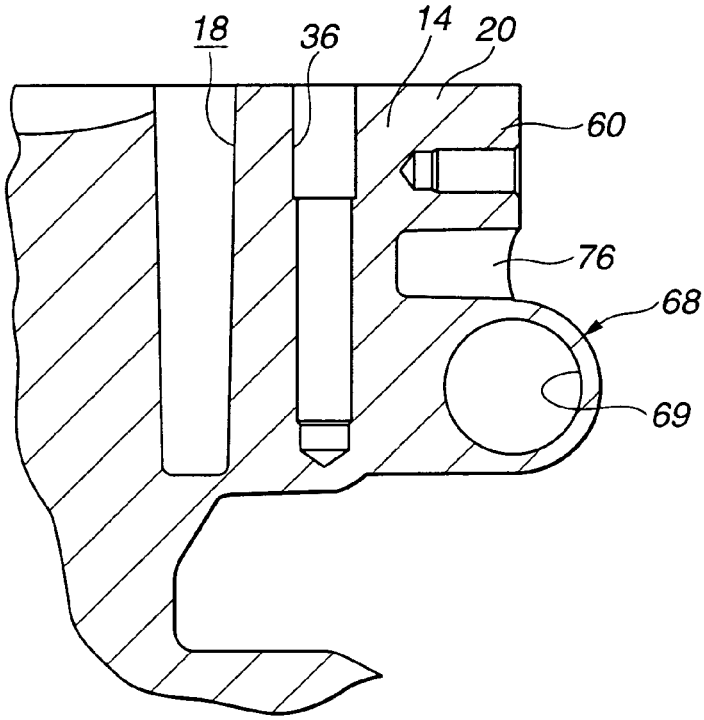
FIG. 2 is a sectional view taken across a line II—II of FIG. 1.
Figure 3:
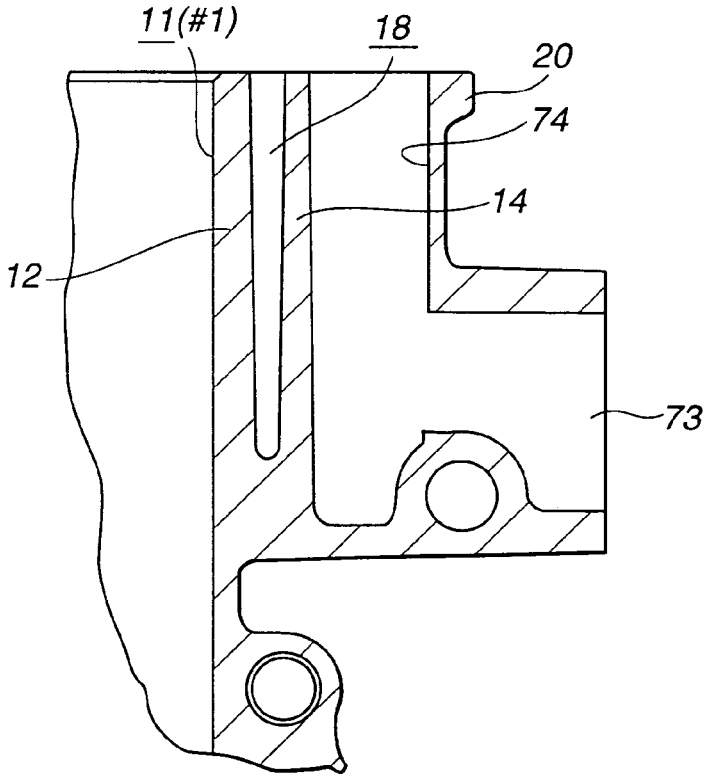
FIG. 3 is a sectional view taken across a line III—III of FIG. 1.

FIGS. 1~3 show a cylinder block for an internal combustion engine, according to a first embodiment of the present invention.

In this example, the internal combustion engine is an inline four-cylinder liquid-cooled engine adapted to be mounted transversely in a vehicle so that the intake side of the engine faces toward the front of the vehicle, and the exhaust side faces toward the rear of the vehicle.

A cylinder block 10 shown in FIGS. 1~3 is a aluminum casting produced by aluminum die-casting process. Cylinder block 10 is formed with four cylinder walls 12 each defining a cylinder bore 11 in which a piston can reciprocate up and down. These four cylindrical cylinder walls 12 are shaped like a hollow cylinder, and arranged in a straight line extending in a cylinder row direction of the engine (in the left and right direction as viewed in FIG. 1). From the front end of cylinder block 10 (the left end of cylinder block 10 in FIG. 1) to the rear end (the right end in FIG. 1), the first to fourth cylinders are arranged in order of #1, #2, #3 and #4.

Cylinder block 10 further includes a block wall (or jacket wall) including first and second (or front and rear) block side walls (jacket side walls) 14. The Block wall surrounds these cylinder walls 12, and defines a water jacket 18. Cooling water flows through water jacket 14 thus formed between the outer periphery of cylinder walls 12 and the block wall, and cools cylinder walls 12.

In this example, cylinder walls 12 are joined in such a Siamese form that adjacent two cylinder walls 12 are connected metal-to-metal. Cylinder block 10 further includes a top deck 20 and a lower deck 22. Each cylinder wall 12 extends in an up-down direction of cylinder block 10, from top deck 20 to lower deck 22.

As shown in FIG. 1, one of the block side walls 14 is formed integrally with a cylindrical knock sensor mounting boss 60 to which a knock sensor is to be fixed, a tubular rib 68 extending in the cylinder row direction, and an accessory mounting flange 62 to which a thermostat as an accessory is to be attached. In this example, the block side wall 14 formed with mounting boss 60, tubular rib 68 and mounting flange 62 is the front (or intake side) block side wall 14 on the front side or intake side facing toward the front of a vehicle when engine block 10 is installed in the vehicle. The knock sensor is arranged to sense knocking in the cylinders #1~#4, and provides a signal which is used by a control for a knocking preventing control such as retardation of the ignition timing. Accessory mounting flange 62 is formed with a plurality of bolt holes 64. An accessory fixing bolt is to be screwed into each bolt hole 64.

Tubular rib 68 has therein a hollow cavity extending in the cylinder row direction, and tubular rib 68 is shaped like a tube. Tubular rib 68 is formed at an intermediate level between top deck 20 and lower deck 22, and bulged outward from the front block side wall 14. Tubular rib 68 is an integral part of the front block side wall 14. Tubular rib 68 extends in the cylinder row direction over two or more cylinders. In the example of FIG. 1, tubular rib 68 extends over the second through third cylinders #2~#4. As shown in FIG. 2, tubular rib 68 of this example is formed in a thick wall portion in which an approximately cylindrical head bolt boss 36 is formed. This head bolt boss 36 is arranged to receive a head bolt for fixing a cylinder head to cylinder block 10.

Tubular rib 68 of this example has therein a coolant passage 69, and serves as a water pipe for circulating cooling water. This coolant passage 69 is a cored hole formed by the casting process. Coolant passage 69 is opened in the rear end of cylinder block 10. The open end of coolant passage 69 is closed by a cap. Coolant passage 69 is connected fluidly with a first cooling water inlet/outlet port 72 formed in accessory mounting flange 62. A second cooling water inlet/outlet port 73 formed in accessory mounting flange 62 is connected fluidly with an auxiliary coolant passage 74 extending, in the up-down direction of cylinder block 10, to an upper end opening in top deck 20 and leading to a coolant passage in the cylinder head.

Knock sensor mounting boss 60 is formed approximately at the middle between the length of cylinder block 10 in the cylinder row direction between the front and rear ends of cylinder block 10, as shown in FIG. 1. In this example, knock sensor mounting boss 60 is located between the second cylinder #2 and the third cylinder #3. Knock sensor mounting boss 60 is cylindrical, and projects from the front cylinder block side wall 14, as shown in FIG. 2. Knock sensor mounting boss 60 is an integral part of cylinder block side wall 14. In this example, knock sensor mounting boss 60 is formed between top deck 20 and tubular rib 68, and connected with tubular rib 68 by two connecting ribs 76 formed integrally in the block side wall 14. Connecting ribs 76 project from the block side wall 14, and extend in parallel to each other, in the up and down direction of cylinder block 10 like fins or bands. Connecting ribs 76 extend from knock sensor mounting boss 60 to tubular rib 68, and thereby connect the outer periphery of knock sensor mounting boss 60 and the outer periphery of tubular rib 68. Part of knock sensor mounting boss 60 is connected smoothly and integrally with top deck 20.

Thus, tubular rib 68 having the inside cavity extends in the cylinder row direction over two or more cylinders, and knock sensor mounting boss 60 is connected with tubular rib 68. Therefore, vibrations of knocking in any of the cylinders can be transmitted effectively through tubular rib 68 to the knock sensor mounting boss 60 by the effect of resonance in the tubular rib 68, so that the knock sensor mounted on mounting boss 60 can detect knocking in any one or more of the cylinders accurately. Knocking in any of the cylinders can be detected effectively by a single knock sensor.

Tubular rib 68 is formed with coolant passage 69 for circulation of cooling water, so that there is no need for attaching a water pipe to the cylinder block. As compared to the addition of an external water pipe, the arrangement of integral tubular rib 68 is advantageous for simplification without the need for mounting bracket and seal member, cost reduction and weight reduction.

In the example shown in FIG. 1, tubular rib 68 is connected with accessory mounting flange 62 formed near the first cylinder #1. Tubular rib 68 terminates near the second cylinder #2, and the end of tubular rib 68 is connected with accessory mounting flange 62 having therein the coolant inlet/outlet ports 72 and 73, and auxiliary coolant passage 74. Accessory mounting flange 62 having these hollow portions can effectively transmit vibrations due to knocking in the first cylinder #1, by the effect of resonance like tubular rib 68. The knock sensor can detect knocking even in the first cylinder.

Tubular rib 68 is cylindrical and the coolant passage 69 therein is circular as shown in FIG. 2. However, tubular rib 68 may be square or rectangular, or shaped like some other figure.

Tubular rib 68 extends in the cylinder row direction, so that it is possible to determine the position of knock sensor mounting boss 60 in the cylinder row direction more freely. Knocking in each of the cylinders can be sensed accurately by a knocking sensor disposed at any position in the cylinder row direction near tubular rib 68.

Figure 4:
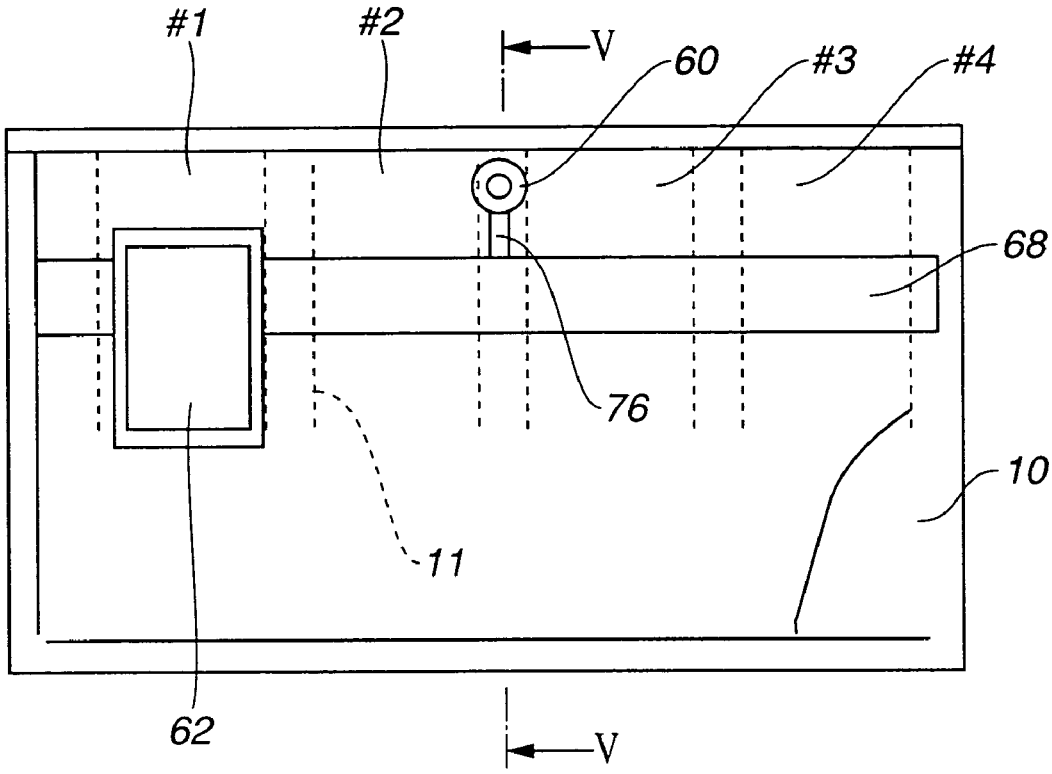
FIG. 4 is a side view of a cylinder block according to a second embodiment of the present invention.
Figure 5:
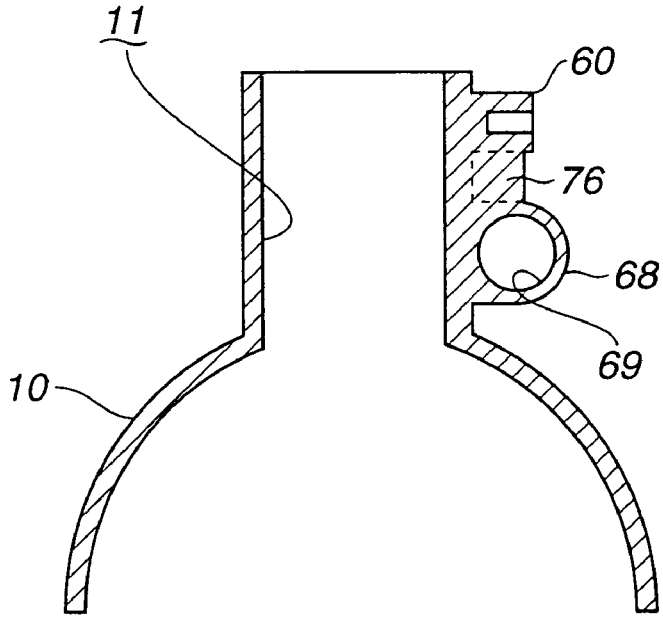
FIG. 5 is a sectional view taken across a line V—V of FIG. 4.

FIGS. 4 and 5 schematically show a cylinder block according to a second embodiment of the present invention. In many points as indicated by the same reference numerals, the cylinder block shown in FIGS. 4 and 5 are substantially identical to the cylinder block of FIGS. 1~3, and repetitive explanation is omitted. In the second embodiment, tubular rib 68 extends over all the four cylinders #1~#4 in the cylinder row direction from a first end to a second end. Accessory mounting flange 62 is formed in an intermediate position between the first and second ends of tubular rib 68. Knock sensor mounting boss 60 is connected integrally with tubular rib 68 by a single connecting rib 76 extending vertically and integrally from the knock sensor mounting boss 60 to tubular rib 68. In the second embodiment, tubular rib 68 extending over the entire cylinder row can function to transmit knocking vibrations effectively from any one of the cylinders in the row, securely to knock sensor mounting boss 60.

Figure 6:
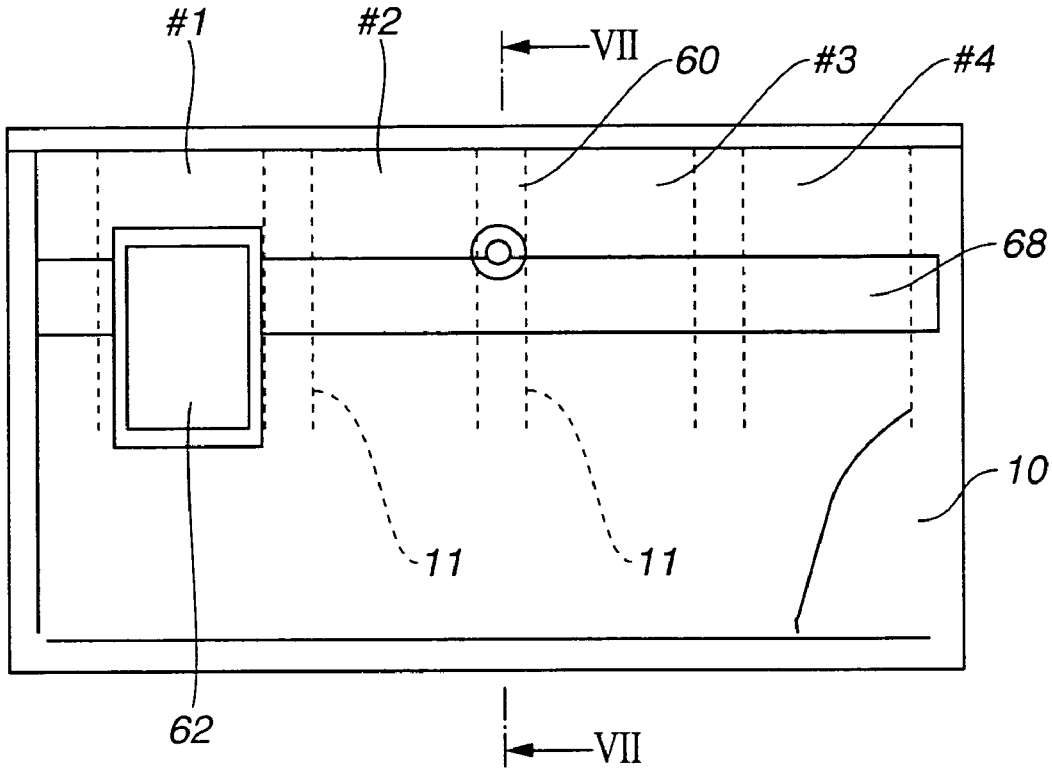
FIG. 6 is a side view of a cylinder block according to a third embodiment of the present invention.
Figure 7:
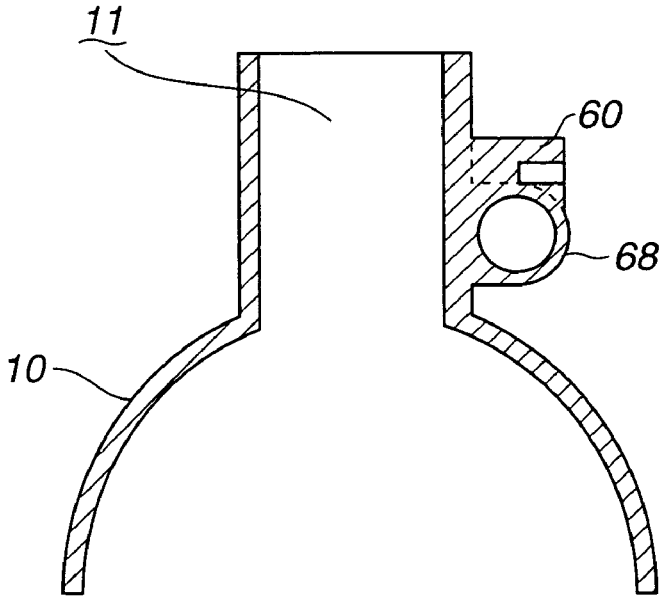
FIG. 7 is a sectional view taken across a line VII—VII of FIG. 6.

FIGS. 6 and 7 schematically show a cylinder block according to a third embodiment of the present invention. In the third embodiment, like the second embodiment, tubular rib 68 extends over all the four cylinders #1~#4 in the cylinder row direction, and accessory mounting flange 62 is formed in an intermediate position between the first and second ends of tubular rib 68. In the third embodiment, unlike the second embodiment, a knock sensor mounting boss 60 is connected directly with the outer circumference of tubular rib 68. Knock sensor mounting boss 60 overlaps tubular rib 68. A lower part of knock sensor mounting boss 60 is formed or buried in tubular rib 68. Knock sensor mounting boss 60 is located at a relatively low position and away from the top deck of the cylinder block. In the third embodiment, there is no need for forming a connecting rib 76. Thus, the third embodiment is advantageous in weight reduction and cost reduction as compared to the first and second embodiment. In the first and second embodiments, it is possible to position the knock sensor mounting boss away from the tubular rib. Therefore, the first and second embodiments are advantageous in the degree of freedom in layout, as compared to the third embodiment.

The invention is not limited to the illustrated embodiments. Various modifications and variations are possible within the scope of the present invention. For example, the present invention is also applicable to an inline six-cylinder internal combustion engine.

This application is based on a prior Japanese Patent Application No. 2003-351580 filed on Oct. 10, 2003. The entire contents of Japanese Patent Application No. 2003-351580 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A cylinder block for an internal combustion engine, comprising:

a knock sensor mounting boss formed on a block side wall, and designed to support an engine knock sensor; and a tubular rib projecting from the block side wall, extending in a cylinder row direction over a plurality of cylinders, and being connected with the knock sensor mounting boss.

2. The cylinder block as claimed in claim 1, wherein the tubular rib is hollow, and having therein a coolant passage for circulating cooling water.

3. The cylinder block as claimed in claim 1, wherein the cylinder block includes a cylinder forming portion defining a plurality of cylinders arranged in an imaginary line extending in the cylinder row direction, a top deck to be fixed to a cylinder head, and a lower deck; the tubular rib extends in the cylinder row direction between the top deck and the lower deck; and the knock sensor mounting boss is formed between the top deck and the tubular rib.

4. The cylinder block as claimed in claim 3, wherein the tubular rib and the knock sensor mounting boss are formed on an outer side of a head bolt boss formed with a bolt hole for receiving a cylinder head bolt for fixing a cylinder head to the top deck of the cylinder block.

5. The cylinder block as claimed in claim 1, wherein the cylinder block further comprises a connecting rib connecting the tubular rib with the knock sensor mounting boss.

6. The cylinder block as claimed in claim 1, wherein the knock sensor mounting boss includes a lower portion formed in the tubular rib.

7. The cylinder block as claimed in claim 1, wherein the tubular rib includes a hollow cavity extending in the cylinder row direction.

8. The cylinder block as claimed in claim 7, wherein the cylinder block further comprises a mounting flange extending in the cylinder row direction from one end of the tubular rib and including a hollow cavity; the tubular rib is connected with the mounting flange; and the hollow cavity of the tubular rib is connected with the hollow cavity of the mounting flange.

9. The cylinder block as claimed in claim 1, wherein the cylinder block is a single casting, and the knock sensor mounting boss and the tubular rib are both integral parts of the casting.

10. The cylinder block as claimed in claim 3, wherein the knock sensor mounting boss includes an upper portion connected with the top deck.

11. The cylinder block as claimed in claim 10, wherein the knock sensor mounting boss is connected with the tubular rib by a connecting rib extending downwards from the knock sensor mounting boss to the tubular rib.

* * * * *